United States Patent [19]

Fleck

[11] 3,966,153

[45] June 29, 1976

[54] CHRISTMAS TREE STAND

[76] Inventor: Jack William Fleck, 4536 Lake Heights St., Bellevue, Wash. 98004

[22] Filed: July 19, 1972

[21] Appl. No.: 273,266

[52] U.S. Cl. ..... 248/512; 248/524; 47/40.5

[51] Int. Cl.[2] ..... A47G 33/12

[58] Field of Search ..... 248/43, 44, 48, 201, 248/314, 359, 360; 211/69.5

[56] References Cited

UNITED STATES PATENTS

| | | | |
|---|---|---|---|
| 497,999 | 5/1893 | Windus | 248/44 |
| 755,555 | 3/1904 | Weaver | 248/201 UX |
| 893,247 | 7/1908 | Killerbrue | 248/44 |
| 1,397,807 | 11/1921 | Hecht | 248/360 |
| 1,943,269 | 1/1934 | Holden | 248/46 |
| 2,502,040 | 3/1950 | Franklin | 248/44 |
| 2,695,152 | 11/1954 | Parulski | 248/314 |
| 2,891,747 | 6/1959 | Steede | 248/44 |
| 3,081,056 | 3/1963 | Young et al. | 248/314 X |

*Primary Examiner*—William H. Schultz
*Attorney, Agent, or Firm*—Christensen, O'Connor, Garrison & Havelka

[57] ABSTRACT

A multiple tree display stand for merchandizers of Christmas trees including horizontally disposed lumber framing members joined by pairs of specially formed brackets which interconnect the framing members at corner intersections thereof, the lower bracket of each pair having an upstruck fastener for impalement of the tree butt and the upper bracket having an upwardly open slot to receive and interengage a broad-headed nail, or the like, preset in the side of the tree trunk near the butt. The dual bracket concept cooperable with a tree with the nail in its trunk is also incorporated in an alternative embodiment usable in a water bucket or the like for use as a home Christmas tree stand. A specially prepared cut Christmas tree having a headed nail selectively located and partially driven into the side of the trunk near the butt end is also featured as part of the invention.

9 Claims, 13 Drawing Figures

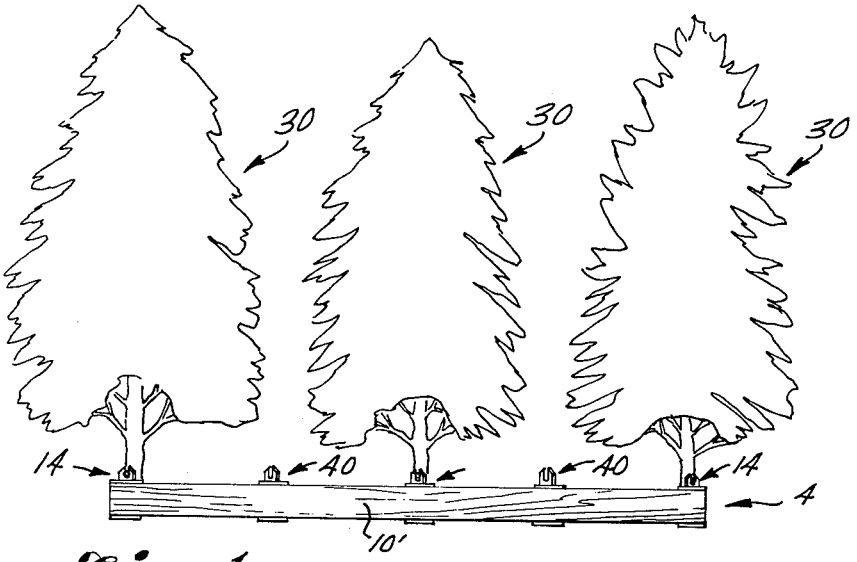
Fig. 1
Fig. 2
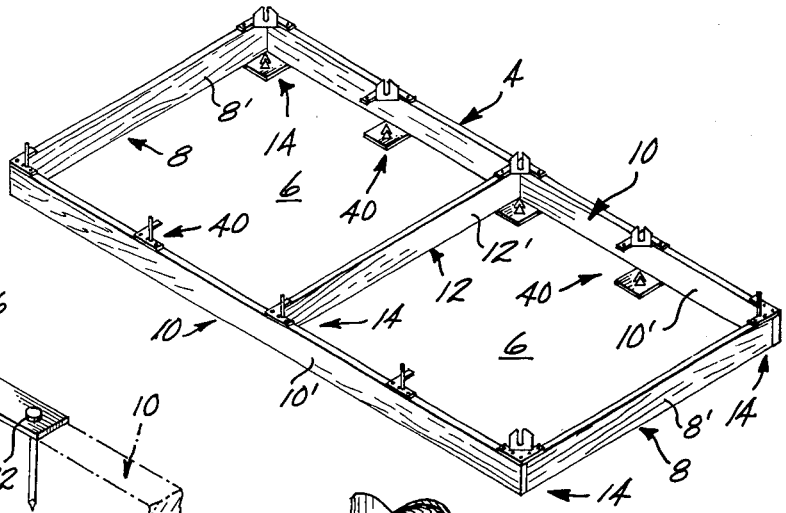
Fig. 3
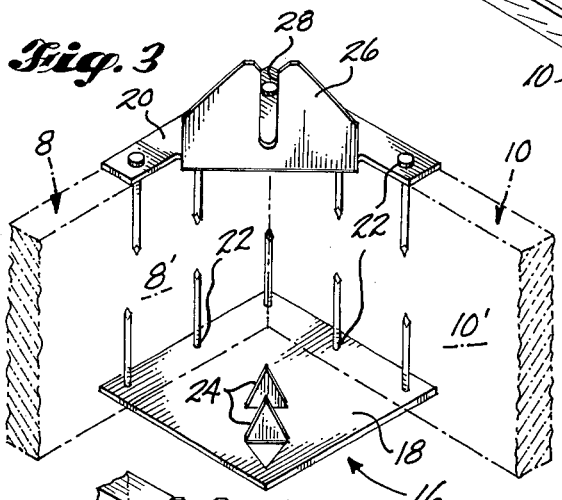
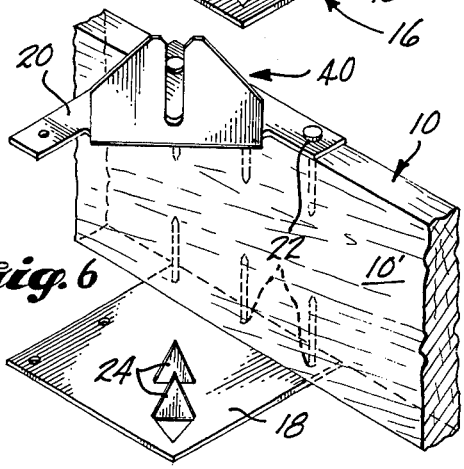
Fig. 6
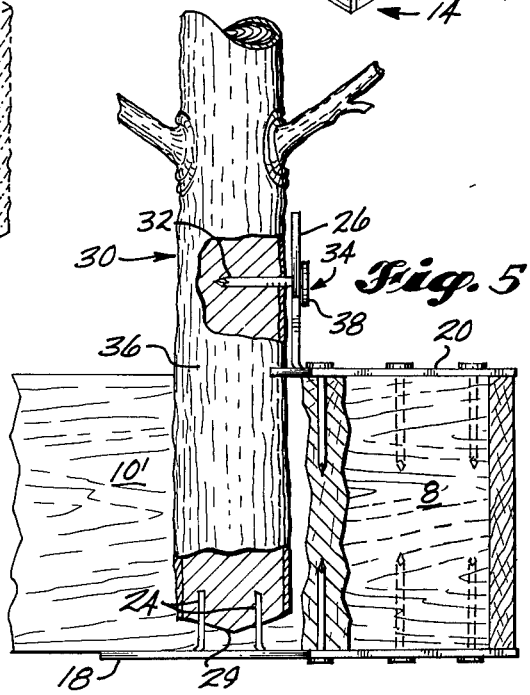
Fig. 5

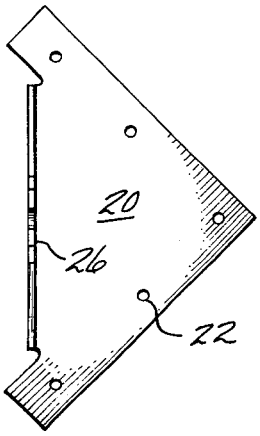
Fig. 7
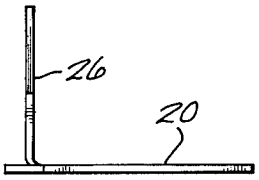
Fig. 8
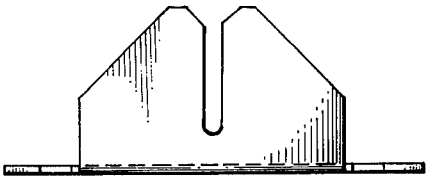
Fig. 9
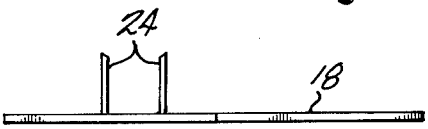
Fig. 11
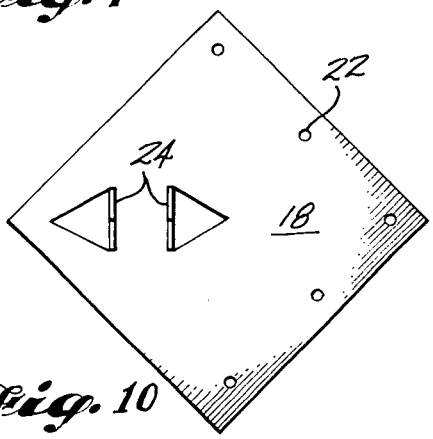
Fig. 10
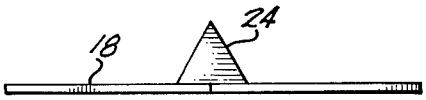
Fig. 12
Fig. 4
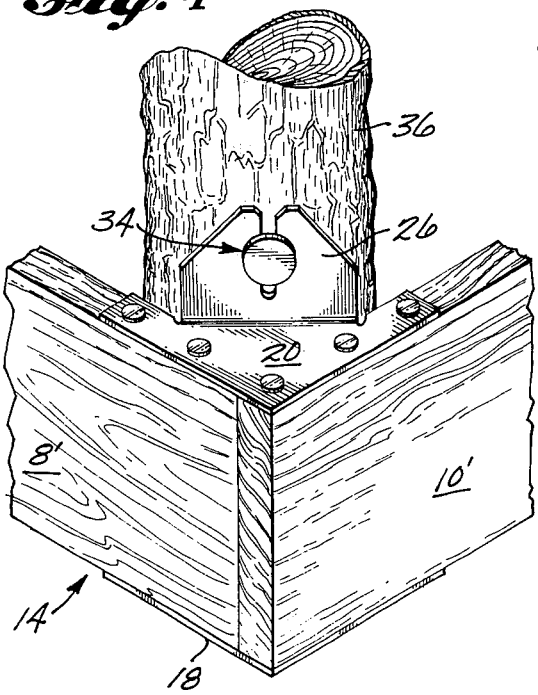
Fig. 13
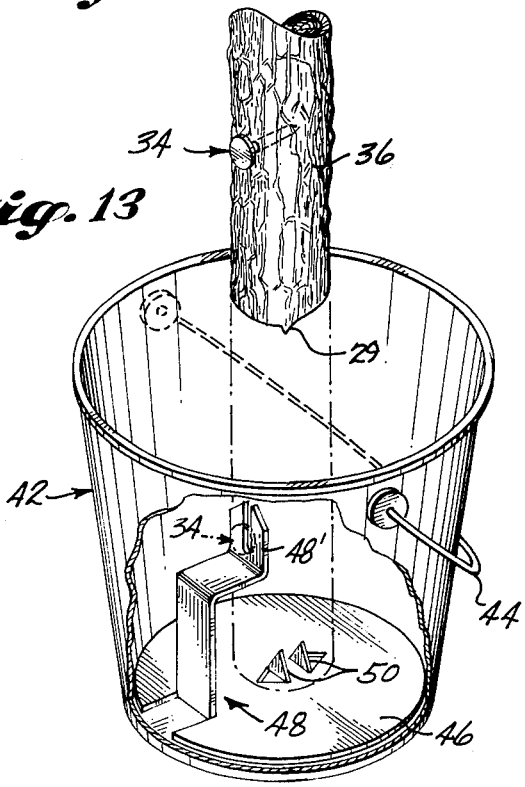

CHRISTMAS TREE STAND

FIELD OF THE INVENTION

This invention relates to the commercial display of cut Christmas trees; more particularly, to the attractive merchandising display of numbers of Christmas trees in standing position spaced apart from each other to permit individual inspection of trees. As a related aspect, the invention also contemplates use of principles and elements employed in the commercial display rack embodiment as elements of a home Christmas tree stand for a single tree, usable in the home, particularly in conjunction with a water bucket in which the cooperable parts of the stand may be received and held so as to immerse the butt of the tree in water.

BACKGROUND OF INVENTION

In the harvesting and marketing of Christmas trees, particularly from large tree farms, the trees are cut, trimmed and compactly bundled for shipment with the branches folded umbrellawise and tied closely along the stem or trunk of the tree. The trees are then shipped in bulk by the farmer to supermarkets and other comparable outlets for display and sale to customers. While the trimming and bundling of trees on a mass basis has presented its special problems, one of the chief difficulties in the successful retail merchandising of trees resides in the effective display of individual trees. As is well known, individual customers tend to be very choosy about a Christmas tree which seems to be a very personal thing, the shape, size and other characteristics of which have special significance to individuals. Consequently, in order to sell Christmas trees effectively, it is really quite necessary that the individual trees be separately displayed in the opened-up or natural standing position for viewing. The problem of providing economically and practically feasible commercial Christmas tree display stands for supermarkets and like commercial usage has been a deterent or obstacle to complete success in such ventures.

In order to display a large number of trees in natural standing position for commercial purposes, it is necessary that the trees be properly spaced from each other and yet not so greatly as to occupy undue amounts of room. It is important that each tree be viewable from different sides so as to permit a complete inspection, that the display stand be sturdy and stable against upset by winds or jostling of customers, and that each display stand tree holder unit be so adapted that once a tree is sold from it, another tree may be quickly positioned and secured in its place. It is also important in such a venture that the display stand be inexpensive to manufacture and that it employ easily assembled and easily disassembled components that can be compactly organized for shipment to the distributor at minimum cost. A further consideration in the provision of commercial Christmas tree display stands for the described purposes is that the same be assembled from components which are sufficiently inexpensive to permit discarding them after use if desired. It is also desirable to provide a structure concept for multiple tree display stands which may be assembled in a variety of geometric forms suiting the spaces available in supermarket lots and similar display areas.

Still another consideration in achieving an effective Christmas tree display system is that of minimizing and simplifying the operations which the merchandiser must perform in setting up the trees in the display stand without unduly adding to the farmer's cost in preparing the trees. In accordance with the teachings of the present invention, the tree is prepared with a nail-like element driven into the side of the trunk of the tree at a selected distance from its butt end that it can cooperate with elements of the display stand in supporting the tree in upright position. This nail-like element is conveniently applied to the tree at the time the trees are packaged at the tree farm and remains in the tree throughout its useful life. In fact the same nail may be utilized, in accordance with a collateral objective of the invention, in cooperation with an individual home tree stand adapting certain principles of the commercial stand inexpensively to displaying the tree in the customer's own dwelling. Here again, the objective is to enhance convenience with which trees are displayed for sale and are then mounted for use and display in the home. Moreover, in further accord with this collateral objective, there is provision for an individual Christmas tree stand wherein the butt of the tree can be supported with its butt immersed in a bucket of water. In this same regard, it is believed to be a common experience that in many homes the resurrection and reconditioning of "last year's" Christmas tree stand or the home workshop manufacture of a new one each Christmas season can be a chore with some vexation such that if there can be provided, as herein, an inexpensive display stand unit unsable with a standard water bucket, a valuable service will have been rendered.

SUMMARY OF THE INVENTION

A Christmas tree stand according to this invention in its disclosed forms comprises a base bearing means having a fastener raised thereon to be impaled in the butt end of the tree trunk; and radial or side bearing means that define a generally vertical bearing surface which is disposed at a location above the generally base bearing means, adjacent a vertical plane coinciding with the fastener, and which has a generally vertically aligned slot therein that opens into an upper edge thereof to receive and interengage with a headed nail-like element driven partially into the trunk a small fractional part of its length above the butt end. The stand also comprises framing means interconnecting the base and side bearing means so as to maintain them in the described positional relationship.

In a commercial multi-tree display stand of this invention, a plurality of horizontally disposed lumber pieces are disposed in abutted intersecting relationship and at the corners are interconnected by and positionally support top and bottom fittings of a pair, the members of which have lines of nail holes for that purpose. These members, preferably formed of sheet metal, respectively carry the nail-engaging slot and impalement features.

As a specific feature, the invention also contemplates a tree fitted with a broad-headed nail-like member partially driven into the side of the cut end of a tree trunk adjacent the butt.

A collateral embodiment of the invention primarily intended for home display of an individual tree purchased with the nail-like element already placed may comprise a base plate which has one or more raised barbs thereon, and a bracket-like framing member which is upstanding on the plate and has a slotted radial bearing member supported on the upper end portion thereof, in a generally vertical plane horizontally offset from the generally vertical plane or planes of the barbs. Such a stand, in itself capable of supporting the tree, is preferably shaped and sized for reception in a water bucket so as to maintain a steadying support for the framing member. If desired, the bottom of the bucket may itself comprise the base plate.

BRIEF DESCRIPTION OF THE DRAWINGS

These features will be better understood by reference to the accompanying drawings which illustrate two of the presently preferred embodiments of the invention.

In the drawings,

FIG. 1 is a side elevational view of a multi-cornered stand in which the bearing means also serve as gusset plates for the corners;

FIG. 2 is a perspective view of the stand;

FIG. 3 is a part perspective view of one corner of the stand, as it is seen from a point inside thereof;

FIG. 4 is a similar view of the corner, as it is seen from a point outside of the stand and with a tree installed therein;

FIG. 5 is a diagonal part cutaway view of the corner, when the tree is installed therein;

FIG. 6 is a part perspective view of an intermediate point on the stand, illustrating the gusset plates in use solely as a tree support;

FIG. 7 is a plan view of the bearing means which are employed as the upper gusset plate;

FIG. 8 is an elevational view of the upper plate along one 90° diagonal thereof;

FIG. 9 is an elevational view of the upper plate along the other 90° diagonal thereof;

FIG. 10 is a plan view of the bearing means which are employed as the lower gusset plate;

FIG. 11 is an elevational view along one 90° diagonal thereof;

FIG. 12 is an elevational view along the other 90° diagonal thereof; and FIG. 13 is a part cutaway perspective view of a tub mounted version.

DESCRIPTION OF THE PREFERRED EMBODIMENT

In the commercial display stand embodiment of FIGS. 1-12, four boards on edge, such as 1 × 6 lumber, two of which are 8 feet long and two 4 feet long, form an open rectangular framework 4, held together at the four corners by tree mounting brackets to be described. A transverse divider board 12 similarly joined to and between the midpoints of the longer side boards of the framework 4 creates two additional frame corners where trees can be supported making a total of six tree support locations in the one framework. As will be clear, other configurations, some with more and some with fewer tree support locations may also be devised on the same basis.

Referring to FIGS. 1–12, in the drawings, it will be seen that the stand comprises a rectangular, open wooden framework 4. The various members 8, 10, and 14 of the frame, are intersectingly abutted and coupled together at the corners 14. The connector means 16 (FIG. 3) for the respective corners are stamped and bent from 12 gauge, hot dipped galvanized sheet steel, each such means comprising a pair of gusset plates 18 and 20, which are underlaid below and superposed on the corner, respectively, and have lines of nail holes 22 along at least two edges thereof, so that they can be nailed to the corner in face-to-face, flushedged relationship with the framing members. In addition, inwardly from the inside surfaces 8 feet, 10 feet or 12 feet, 10 feet of the corner, each plate has at least one relatively upturned diagonally disposed flange thereon, there being two flanges 24 on the relatively lower plate, taking the form of pointed teeth or barbs that are cut and bent up out of the plane of the plate, in spaced parallel relationship to one another; and a single flange 26 on the relatively upper plate, taking the form of a right angularly disposed bracket having a deep vertically aligned slot 28 in the upper edge thereof. The barbs 24 are intended to be impaled in the butt 29 of the tree 30; whereas the slot 28 is intended to receive the shank 32 of a broad-headed nail 34 similar to a roofing nail, which is partially driven into the trunk 36 of the tree, a small fractional part of its length from the butt end, and between which the trunk is preferably trimmed as needed and to prevent interference from branches and other growth with elements of the stand. With the nail driven properly, its head 38 is spaced out from the trunk by a distance which allows the slot 28 to straddle the shank of the nail, without undue free play of the bracket 26 between nail head and adjacent tree trunk. Moreover, the bracket portion having slot 28 is horizontally inset from the inside surfaces 8 feet, 10 feet or 12 feet, 10 feet of the frame corner faces, to allow clearance for irregularities on the tree trunk so they do not interfere with installation of the tree. When the tree is installed, the nail enters the top of the slot first, then the tree is thrust downward, guided by the slot so as to impale the butt end by the barbs 24.

The frame may assume other plan configurations, such as a triangular configuration, and similarly, the gusset plates may also assume other configurations than the essentially square-shaped and triangular plan configurations shown for the plates 18 and 20, respectively.

Also, if desired, the pairs of connectors 18 and 20 may be employed at intermediate (non-corner) locations on the frame solely for the tree supporting function thereof. Thus, in FIGS. 1, 2, and 6, additional pairs 40 of plates are nailed along one edge thereof, to the longer rails 10 of the frame, and cantilevered from the frame, inwardly of the square 6, to support additional trees than those seen in FIG. 1.

Furthermore, the same principle can be applied to a tree stand that is adapted to accommodate only a single tree such as for home use, as in the case of that shown in FIG. 13. In this instance, the stand is usable in a common water bucket 42 with bail 44. The bottom of the stand in this case is defined by a sheet metal disc 46. An upright bracket 48 is bent upward from the disc near one side thereof, then inwardly to a location short of the vertical center axis of the disc and finally upwardly. The upper extremity of the bracket comprises the slotted nail receiving portion 48 feet of the stand. A pair of spaced barbs 50 are struck up from the center of the disc to engage the butt end of the tree.

In addition to water, sand, rocks, or other ballast may be placed in the bucket overlying the disc if desired.

What is claimed is:

1. A Christmas tree stand for use with a Christmas tree having a headed nail-like element driven partially into the side of the tree trunk a small fractional part of its length above the butt end thereof, said stand comprising a bottom member having an upwardly pointed prong adapted to impale the butt end of the Christmas tree, an upper member having an upwardly open slot extending generally vertically adapted to slidably receive and retain the nail-like element with the head of the nail on one side and the side of the tree trunk on the opposite side of said slotted upper member, and means interconnecting the bottom and upper members in fixed positional relationship which maintains the tree in upright position.

2. The tree stand defined in claim 1 wherein the bottom member further comprises a supporting horizontal base of such horizontal dimensions of itself as to maintain the tree in erect position thereon, the prong and slot being located generally centrally relative to said base.

3. The Christmas tree stand defined in claim 1 wherein the bottom member comprises a plate-like sheet material gusset with nail holes located on respective lines intersecting at an angle and the upper member is of sheet material including a first portion incorporating the slot and a plate-like gusset portion turned substantially at right angles to the first portion and also provided with nail holes located on respective lines in the same angular relationship as and superimposed over the lines of nail holes in the bottom member gusset, and intersectingly abutted lumber pieces disposed horizontally, said gussets respectively overlying and underlying the top and bottom faces of the abutted lumber pieces and interconnecting the same by means of nails driven through the nail holes into said lumber pieces.

4. The Christmas tree stand defined in claim 1 wherein the bottom member comprises a plate-like sheet material gusset with nail holes and the upper member comprises a plate-like gusset of sheet material turned at right angles to the extent of the slot and also provided with nail holes whereby the bottom and upper members may be secured by nails to the bottom and top faces of a board standing on edge.

5. A tree stand comprising base bearing means that define a generally horizontal bearing surface having an impalement fastener raised thereon to be impaled in the butt of the tree, radial bearing means defining a generally vertically aligned slot to receive and interengage with a flanged lug, preapplied to one side of the tree trunk, when the butt is impaled on the fastener, and support means rigidly interconnected with the respective bearing means to maintain the radial bearing means in fixed relation to the base bearing surface.

6. A Christmas tree stand for use with a Christmas tree having a headed nail-like element driven partially into the side of the tree trunk a small fractional part of its length above the butt end thereof, said stand comprising a bottom member having an element adapted to separably engage the butt end of the Christmas tree, an upper member having an open slot extending generally vertically adapted to slidably and separably receive and thus engage the nail-like member with the head of the nail positioned on one side and the side of the tree trunk on the opposite side of said slotted upper member, and means interconnecting the bottom and upper members in fixed positional relationship which maintains the tree in upright position.

7. The tree stand defined in claim 2, wherein the bottom and upper members are interconnected by an upright standard of integral one-piece construction with such members.

8. The tree stand defined in claim 1, wherein the bottom and upper members comprise sheet material plates with fastener elements by which to fasten the same to surfaces of a support frame board.

9. A commercial Christmas tree stand comprising a plurality of intersecting boards extending horizontally on edge and joined at their intersections at top and bottom edges by sheet metal gussets, the bottom ones of which have horizontally projecting portions with upwardly pointed prongs thereon to impale the butts of cut Christmas trees and the upper ones of which have horizontally projecting portions with vertically turned bearing members thereon which have vertically open slots therein slidably engageable with nail-like elements driven into one side of such Christmas trees above their respective butts so as to retain such elements in the slots and thereby stabilize in upright positions the trees thus impaled.

* * * * *